United States Patent [19]

Husak et al.

[11] Patent Number: 4,549,742

[45] Date of Patent: Oct. 29, 1985

[54] ICE SKATE

[75] Inventors: Zdenek Husak; Zdenek Svozil; Ivan Mazak, all of Olomouc; Josef Lehky, Vrbatky; Josef Hora, Police n/Met; Zdenek Smid, Uhonice; Ondrej Kebrle, Brno, all of Czechoslovakia

[73] Assignee: Koh-i-noor Bilovec, norodni podnik, Bilovec, Czechoslovakia

[21] Appl. No.: 528,233

[22] Filed: Aug. 31, 1983

Related U.S. Application Data

[63] Continuation-in-part of Ser. No. 260,762, May 5, 1981, abandoned.

[30] Foreign Application Priority Data

May 5, 1980 [CS] Czechoslovakia ..... 3265-80

[51] Int. Cl.[4] ..... A63C 1/32

[52] U.S. Cl. ..... 280/11.18; 264/273

[58] Field of Search ..... 280/11.12, 11.17, 11.18, 280/11.1 R; 264/273, 278; 249/88

[56] References Cited

U.S. PATENT DOCUMENTS

| | | | |
|---|---|---|---|
| 1,115,790 | 11/1914 | Drevitson | 280/11.17 |
| 3,967,832 | 7/1976 | Chambers | 280/11.12 |
| 4,053,168 | 10/1977 | Goverde | 280/11.12 |
| 4,223,900 | 9/1980 | Olivieri | 280/11.12 |
| 4,336,948 | 6/1982 | Couture | 280/11.12 |

FOREIGN PATENT DOCUMENTS

| | | | |
|---|---|---|---|
| 953308 | 3/1964 | United Kingdom | 280/11.18 |

*Primary Examiner*—Joseph F. Peters, Jr.
*Assistant Examiner*—Mark C. Dukes

[57] ABSTRACT

An ice skate having a metal blade with the upper edge thereof embedded in the lower portion of the body of the skate which is made of plastic material. Plastic material integral with the body of the skate extends through longitudinally directed through-holes in the upper edge of the blade. There are at least three through-holes, including a centrally disposed centering through-hole which is entirely filled with plastic material integral with the material of the skate body. The other through-holes, located respectively forwardly and rearwardly of the centering through-holes, are only partially filled with plastic material integral with the body of the skate, the ends of the other through-holes which lie nearer the central through-hole being empty whereby to allow longitudinal shifting of the molded plastic body of the skate as it cools and hardens after having been injection-molded about the upper edge of the skate blade. The minimum dimensions of the spaces within said forward and rear through-holes are determined by the shrinkage of the plastic material, and by the distance of said additional through-holes from the centrally located, centering through-hole.

2 Claims, 3 Drawing Figures

ICE SKATE

This invention is a continuation-in-part of application Ser. No. 260,762, filed May 5, 1981, now abandoned.

This invention relates to an ice skate composed of a body made of plastic and a skate blade secured to the skate body. The connection between the blade and body is such as to take into consideration the change of dimension of the plastic body as it cools from its as molded condition.

In the prior art, metal skate blades have been affixed to skate bodies made of plastic material by the provision of holes in the upper part of the skate blade wherein the same plastic material which forms the body or bearing part of the skate extends. See for example Austrian patent No. 254,009, in which there are also provided reinforcing protrusions on the skate blade, such protrusion extending into the skate body. The holes in the upper part of the skate blade are usually through-holes, but they may be only partial openings or hollows. In such skates, no consideration has been given to the thermal change of dimension of the plastic material forming the body of the skate. The areas of mutual penetration of the plastic material and the metal skate blade are disposed to the highest stress upon the shrinkage of the plastic material.

When a space to accomodate change of dimensions of the plastic material is not provided in critical places, mechanical damage and eventual cracking of the plastic material takes place. The elimination of this drawback has been solved by skate manufactures in various manners. For example, U.S. Pat. No. 3,967,832 uses a hollow rivet or an eye with a flange for the reinforcement of the connection between the skate blade and the plastic material, the diameter of the holes in the skate blade being larger than the external diameter of the rivet or eye in an amount of 1% of the change of dimension of the plastic material. The outer side of the space between the rivet and the skate blade is covered with a flange. During the molding process, the plastic material flows through the hole inside the eye or hollow rivet which connects the steel skate blade with the skate body made of plastic material. The flange prevents leakage of plastic material between the external diameter of the rivet and the hole in the skate blade. After completion of the molding operation, the plastic material cools down and shrinks in the place of the highest stress into the space between the external rivet diameter and the hole in the skate blade; this prevents mechanical damage of the plastic skate body. However, the skate according to U.S Pat. No. 3,967,832 is not centered, so that a longitudinal shifting of the skate blade with respect to the plastic material of which the body is made can thus take place.

An analogous principle is used in DOS No. 2 638 643 which discloses a skate of a similar type, and a process for its production. According to this disclosure, a pin is inserted into a through-hole in the skate blade before the casting in of the plastic material. The pin is removed after the plastic material forming the body of the skate has become rigid, and the connection is reinforced by a rivet having a smaller diameter than the hole in the skate blade. After the plastic material has hardened, holes in the plastic material to receive a rivet or rivets can be subsequently drilled. Use of a rivet or eye requires substantial labor, and it does not exclude the change of dimension of the plastic material and thus an undesirable shift of the skate blade in the transverse direction, that is, in the direction with respect to the blade edge which protrudes from the plastic material and which comes into engagement with the ice.

The above-described prior art ice skates eliminate mechanical damage of the plastic body of the skate as a result of thermal change of dimension of the plastic material by providing a shiftable connection between the upper part of the skate blade and the plastic material of the skate body. The ICE Company has solved this problem by providing a specific shape of the skate blade. Such blade does not have a straight upper area. The blade is longitudinally cut out in the middle part along approximately two-thirds of its upper area, the cut-out encroaching upon both sides to the end parts of the blade, the upper part of which is not cut out. A projection with a centering through-hole is disposed at the longitudinal center of the skate blade. This construction permits change of dimension of the plastic material in the direction toward the skate center, and prevents the plastic material from being damaged, much to the detriment of the security of gripping of the skate blade by the plastic body of the skate.

The above-mentioned drawbacks of the prior art are overcome by a skate according to the present invention. In accordance with the invention, a centering through-hole is provided at the longitudinal center of the upper part of the skate blade, there being at least two side through-holes in the upper part of the skate blade, the side holes being disposed forwardly and rearwardly of the center through-hole. A filler of plastic material which is integral with the body of the skate fills the centering through-hole. The side through-holes are filled with such plastic material only at the ends thereof remote from the centering hole, there being provided spaces in the ends of the side through-holes which are nearer the centering through-hole.

So-called "dilatation spaces", which allow the change of dimensions of plastic material only in a longitudinal direction, are formed in the inner ends of the side through-holes by the partial filling up of the through-holes in the skate blade. The through-holes are filled with plastic material to such an extent that they ensure a sufficient firmness of anchorage of the skate blade in the plastic body of the skate. The blade is ensured by the centering hole against its longitudinal shifting with respect to the skate body, such centering hole being entirely filled with plastic material. Such solution of the problem of the change of dimensions of the plastic material of the skate body is very simple, and poses minimum requirements for labor in the mass production of an ice skate having its body made of plastic material.

More specifically, during the die-casting process, the central hole in the blade body is entirely filled up by the plastic material. The side holes are filled up partially only since a complete filling-up is prevented by said projections of the mold, which projections engage into the radial terminations of said side holes adjacent the central hole. After the plastic material has hardened, the skate is removed out of the mold and is allowed to further get cold. Due to a variation of temperature of the plastic material, a dimensional contraction takes place. Since the blade body is firmly fixed in the skate body at the central hole, the material contraction occurs in the side holes toward the skate central portion. The material of the skate body partially fills up the holes left after the projections in the elongated through-holes while simultaneously is displaced away from radial terminations of said through-holes at the opposite sides.

In this way there are provided at the two end portions of the elongated through-holes dilation joints which allow dimensional changes of the plastic material in the direction of longitudinal axes of said holes in accordance with temperature conditions without any rise of internal stress in the plastic material, due to a pressure contact at the boundary of the two materials united. Since the dimensions of the projections forming the vacant spaces adjacent the inner radial terminations are larger than the plastic material decrease due to the contractibility thereof, the complete filling-up of said space cannot occur when the skate is cooled to the normal operation temperature.

The invention will be more fully understood upon consideration of the accompanying drawings which illustrate a preferred example of the skate of the invention. In the drawings.

Figure 2:
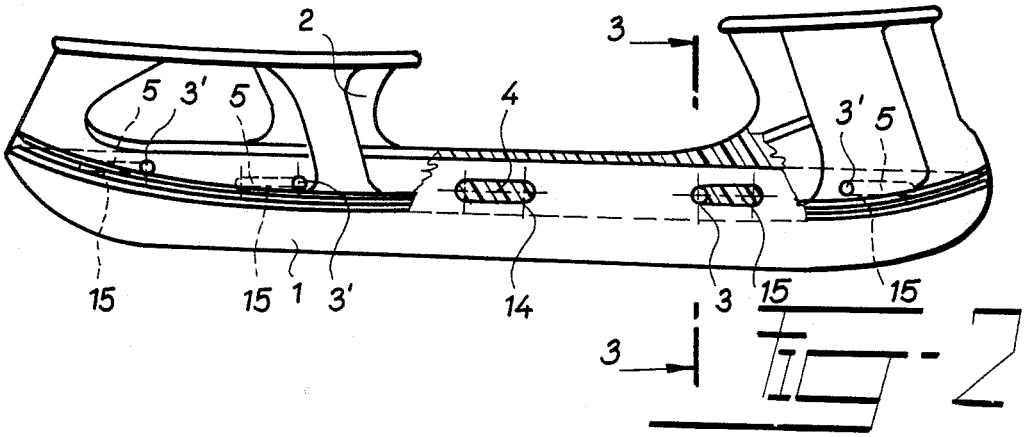
FIG. 2 is a view of the combined skate blade and plastic skate body, such view being partially in side elevation and partially in vertical longitudinal section.
Figure 3:
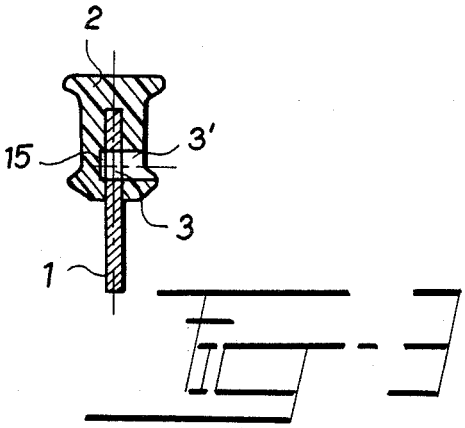
FIG. 3 is a view in transverse section through the skate of FIG. 2, the section being taken along the line 3—3 of FIG. 2.

The skate of the invention is composed of two basic elements, the skate blade 1 and the bearing or skate body 2 made of plastic material. The upper portion of the skate blade 1, which has an upper edge which is substantially straight and unbroken, is embedded in the lower longitudinal portion of the body 2, as shown in FIGS. 2 and 3. The depth to which the blade 1 extends into the body 2 is the largest in the longitudinal middle part of the blade and becomes smaller in directions toward the forward end rear ends of the blade. The upper edge 11 of the blade 1 is straight. The lower edge 12 of the blade 1 is slightly curved in its central section, the ends of the blade being markedly arcuate at 13 and finally emerging at its upper end with the upper edge 11 of the blade.

Figure 1:
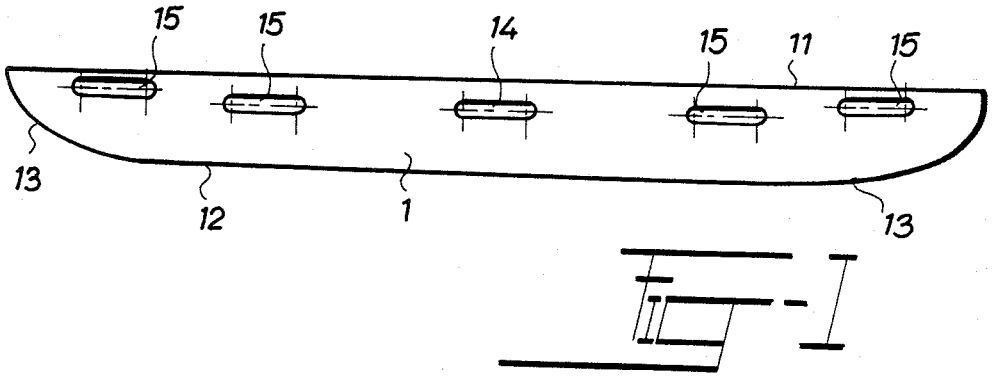
FIG. 1 is a view in side elevation of the steel skate blade employed in the skate of the invention.

Along the upper edge 11 of the blade 1 there are disposed a central through-hole 14 and further, forward and rear through-holes 15. The holes 14 and 15 are elongated in a direction longitudinally of the skate, the upper and lower edges of such holes being parallel and the ends thereof being arcuate. The through-holes 14 and 15 need not be disposed in one horizontal plane; in the embodiment shown, the forward and rear through-holes 15 are located closer to the upper edge 11 of the blade 1 than is the central through-hole 14. The spacing of the various through-holes 14, 15 in a vertical direction is governed by the length of penetration of the upper edge 11 of the knife 1 into the plastic body 2 of the skate. As shown in FIGS. 1 and 2, the further, forward and rear through-holes are disposed distances which are large fractions of the length of the blade forwardly and rearwardly, respectively, of the central through-hole through the blade.

There should be at least three through-holes, including the central through-hole 14 and at least one forward and one rear through-hole 15. In the embodiment shown, there are two longitudinally spaced forward through-holes and two longitudinally spaced rear through-holes 15. The centering through-hole 14 is disposed at the transverse axis of the blade 1. In manufacturing the skate, the blade 1 is located as an insert in a mold of suitable shape, the plastic material which is to form the body 2 being injected under pressure and heat into the mold. During such molding operation, the plastic material which forms the body 2 also flows into the through-holes 14 and 15. Thus the bearing or main body 2 of the skate forms a unit with the blade 1.

The centering through-hole 14 is entirely filled with plastic material as shown at 4 in FIG. 2. The forward and rear side through-holes 15 are filled only partially with plastic material, the plastic material filling such holes at the ends thereof which are remote from the central through-hole 14. This is accomplished by the provision of cores in the mold which extend transversely of the blade 1 in to the ends of the holes 15 in the blade at the ends of such holes nearer the longitudinal center of the blade. In making the skate shown, such cores are cylindrical in section, and in the mold extend through the holes 15 and somewhat beyond the skate blade 1. Thus there is formed in the finished skate voids or spaces 3' which extends inwardly of the body 2 from the right side thereof (FIG. 3), spaces or voids 3' including the end portions of the holes 15 which lie nearer the central through-hole 14. It will be seen in FIGS. 2 and 3, that the spaces or voids 3' have appreciable longitudinal dimensions when compared to the length of the through-holes 15 through the blade 1.

The minimum size of the spaces or voids 3' is determined by the shrinkage of the plastic material and by the distance which the respective holes lie from the centering-through hole 14. The outer ends of the holes or voids 3' can be masked if desired at their laterally outer ends for aesthetic reasons.

At the cooling of the plastic material which forms body 2 of the skate, and its subsequent hardening, because of such temperature variation, changes in dimension of the plastic material, particularly shrinkage thereof in a longitudinal direction, takes place. Such change in dimension takes place primarily in a longitudinal direction toward the centering through-hole 14. The centering through-hole 14, which is entirely filled with plastic material 4 integral with body 2 of the skate, forms a fixed anchorage for the blade 1 and the body 2 of the skate, and thus secures the blade 1 against longitudinal shifting with respect to the body 2.

It is obvious that the skate of the invention may be used for any purpose, including ice hockey, figure skating, and just plain pleasure skating.

Although the invention is illustrated and described with reference to one preferred embodiment thereof, it is to be expressly understood that it is in no way limited to the disclosure of such preferred embodiment but is capable of numerous modifications within the scope of the appended claims.

We claim:

1. In an ice skate comprising a molded integral support body made of plastic material and a metal skate blade having a body with a forward end, a rear end, and a substantially straight, unbroken upper edge, the upper portion of the blade having been embedded in the lower portion of the support body during the molding of the support body, the improvement wherein the skate blade has in the longitudinal direction thereof a central through-hole which is entirely filled by a portion of the molded plastic material of the support body which was introduced thereinto during the molding of the support body, the skate blade body having at least two further through-holes therein located below the upper edge thereof, one of which is disposed a distance forwardly of the central through-hole which is a large fraction of the length of the blade and the other of said further through-holes in the blade being disposed a distance rearwardly of the central through-hole which is a large fraction of the length of the blade, the two further through-holes in the skate blade being elongated in the longitudinal direction of the blade, further portions of the plastic material of the support body extending through said at least two further through-holes in the blade, said further portions of the plastic material having been introduced into said at least two further through-holes in the blade during the molding of the support body, said further portions of the plastic material completely filling a longitudinal part of substantial length of said at least two further through-holes in the blade, said two further portions of the plastic support body being shorter in the longitudinal direction of the skate blade than the at least two further through-holes in the skate blade, whereby voids of appreciable longitudinal dimensions are present between the ends of the respective further through-holes which lie adjacent the central through-hole in the blade and the confronting ends of the further portions of the plastic support body disposed in the respective further through-holes in the blade.

2. An ice skate according to claim 1, wherein the central through-hole in the blade is elongated in the longitudinal direction of the blade.

* * * * *